US006655360B1

(12) United States Patent
Joos et al.

(10) Patent No.: US 6,655,360 B1
(45) Date of Patent: Dec. 2, 2003

(54) METHOD FOR REDUCING THE FUEL PRESSURE IN A NON-RETURN FUEL SUPPLY SYSTEM

(75) Inventors: Klaus Joos, Walheim (DE); Jens Wolber, Gerlingen (DE); Thomas Frenz, Noerdlingen (DE); Hansjoerg Bochum, Novi, MI (US); Markus Amler, Leonberg-Gebersheim (DE)

(73) Assignee: Robert Bosch GmbH, Stuttgart (DE)

( * ) Notice: Subject to any disclaimer, the term of this patent is extended or adjusted under 35 U.S.C. 154(b) by 12 days.

(21) Appl. No.: 10/111,208

(22) PCT Filed: Oct. 11, 2000

(86) PCT No.: PCT/DE00/03562

§ 371 (c)(1),
(2), (4) Date: Apr. 23, 2002

(87) PCT Pub. No.: WO01/31185

PCT Pub. Date: May 3, 2001

(30) Foreign Application Priority Data

Oct. 23, 1999 (DE) ..... 199 51 132

(51) Int. Cl.[7] ..... F02M 37/04
(52) U.S. Cl. ..... 123/497
(58) Field of Search ..... 123/497, 198 D, 123/198 DB

(56) References Cited

U.S. PATENT DOCUMENTS 4,704,997 A * 11/1987 Endo et al. ..... 123/198 DB
4,782,808 A * 11/1988 Bostick et al. ..... 123/467
5,074,272 A * 12/1991 Bostick et al. ..... 123/514
5,441,026 A * 8/1995 Akimoto ..... 123/198 D
5,727,516 A 3/1998 Augustin et al.
5,785,025 A 7/1998 Yoshiume et al.

FOREIGN PATENT DOCUMENTS

| | | |
|---|---|---|
| DE | 44 45 586 | 6/1996 |
| DE | 195 39 883 | 11/1996 |
| EP | 0 501 459 | 9/1992 |
| EP | 0 825 056 | 2/1998 |

* cited by examiner

*Primary Examiner*—Thomas N. Moulis
(74) *Attorney, Agent, or Firm*—Walter Ottesen

(57) ABSTRACT

The invention relates to a method for reducing the fuel pressure in a return-free fuel supply system of an internal combustion engine to a desired pressure value. At least one fuel pump is mounted in the fuel supply system. In order to be able to reduce the fuel pressure in the fuel supply system in a simple manner without additional pressure release valves, the suggestion is made that the fuel supply system and the internal combustion engine be operated in a pressure-reduction mode wherein at least one fuel pump of the fuel supply system is so controlled (open loop and/or closed loop) that the desired pressure value is adjusted in the fuel supply system. The fuel supply system is preferably configured as a common-rail storage injection system for a direct-injecting internal combustion engine.

10 Claims, 2 Drawing Sheets

METHOD FOR REDUCING THE FUEL PRESSURE IN A NON-RETURN FUEL SUPPLY SYSTEM

FIELD OF THE INVENTION

The present invention relates to a method for releasing the fuel pressure in a return-free fuel supply system of an internal combustion engine to a desired pressure value. At least one fuel pump is mounted in the fuel supply system. The invention further relates to a control of an internal combustion engine having a return-free fuel supply system wherein at least one fuel pump is mounted.

BACKGROUND OF THE INVENTION

In a fuel supply system, fuel is pumped from a fuel tank by a fuel pump via a pressure line to a fuel distributor having injection valves, the fuel distributor being located on the internal combustion engine. In some fuel supply systems, a return line branches off from the fuel distributor and leads back to the fuel tank. The fuel quantity, which is not needed by the engine, flows back into the fuel tank through the fuel distributor via the return line. In this way, an increase of the fuel temperature in the fuel tank takes place during the operation of the engine.

In contrast, there is no return line from the fuel distributor to the fuel tank in return-free fuel supply systems, whereby the warming of the fuel in the fuel tank can be reduced. In this way, the statutory requirements with respect to fuel vaporization on a motor vehicle can be more easily satisfied.

In accordance with the state of the art, modern internal combustion engines are operated with relatively high fuel pressures in the fuel supply system. However, it can be necessary to reduce the fuel supply system to a lower pressure value below the operating pressure for the purpose of maintenance work or repairs. In return-free fuel supply systems, a reduction of the fuel pressure can take place only via the injection valve except if an additional pressure release valve is present in the fuel distributor.

The problem of reducing the fuel pressure in a return-free fuel supply system is present especially in common-rail storage injection systems for direct-injecting diesel or gasoline engines. A fuel high-pressure store is provided as a fuel distributor in common-rail storage injection systems. Fuel is first supplied from the fuel tank by a presupply pump to a downstream high-pressure supply pump. The presupply pump is configured as an electric fuel pump. The high-pressure supply pump pumps the fuel at a very high pressure into the fuel high-pressure store from where it reaches the injection valves configured as injectors. In accordance with the present state of the art, direct-injecting diesel engines are operated at fuel pressures of up 1,500 bar and direct-injecting gasoline engines are operated at fuel pressures of 50 to 100 bar. This pressure must be dropped to a lower pressure value for the purpose of maintenance work and repairs. Even a pressureless fuel high-pressure store can be necessary.

SUMMARY OF THE INVENTION

It is the task of the present invention to be able to reduce the fuel pressure in a return-free fuel supply system of an internal combustion engine to a desired pressure value as required as fast as possible and without the use of additional pressure release valves.

Starting from the method for reducing the fuel pressure of the type mentioned initially herein, the invention suggests for the solution of this task that the fuel supply system and the internal combustion engine are operated in a pressure reduction operation wherein at least one fuel pump of the engine is so controlled (open loop and/or closed loop) that the desired pressure value is adjusted in the fuel supply system.

In the method according to the invention, the fuel pressure is therefore reduced via the injection valves. For this purpose, the fuel supply system and the internal combustion engine are operated in a pressure reduction operation. In this operation, at least one fuel pump of the fuel supply system is so controlled that the desired pressure value is adjusted in the fuel supply system. Already after a few revolutions of the engine, the desired pressure value is present in the entire fuel supply system, especially in the fuel distributor. The method of the invention affords the advantage that the fuel pressure in a return-free fuel supply system can be reduced to the desired pressure value without the use of additional pressure release valves.

Especially return-free high-pressure fuel supply systems have a requirement-controlled pressure control. To reduce the fuel pressure, the pressure control can be so controlled in the pressure-reduction operation, that the desired pressure value adjusts in the fuel supply system.

During operation of the internal combustion engine in the pressure reduction operation, the engine can be operated, for example, in idle or in any other operating state. The operating state of engine is dependent upon the nature of the service or repair cycle which should be run through during the pressure reduction operation. The at least one fuel pump pumps fuel from the fuel tank at the desired pressure value into the fuel supply system. In this way, with time, a reduction of the fuel pressure in the fuel supply takes place from the operating pressure to the desired pressure value. After a few revolutions of the engine, the desired pressure value is present in the fuel supply system. The fuel pressure can, however, be only reduced so far that it is still sufficient for injecting fuel. As soon as the fuel pressure in the fuel supply system becomes too low in order to inject fuel into the combustion chamber, the engine stalls.

The method of the invention is suitable especially for the use with high-pressure fuel supply systems. These are, for example, configured as return-free common-rail storage injection systems for direct-injecting diesel engines or gasoline engines. With the method of the invention, the high pressures, which are present in such fuel supply systems, can be rapidly reduced in a simple manner.

According to an advantageous further embodiment of the present invention, it is suggested that, in a high-pressure fuel supply system having a presupply pump and a high-pressure supply pump, the high-pressure supply pump is so driven that the desired pressure value adjusts in the fuel supply system. The fuel pressure in the fuel supply system can be adjusted to a desired pressure value which lies between the high operating pressure and the pressure of the presupply pump.

In order to reduce the fuel pressure further, it is suggested in accordance with a preferred embodiment of the invention that the presupply pump is driven in a targeted manner. Then, a reduction of the fuel pressure in the fuel supply system is also possible to a desired pressure value below the pressure generated by the presupply pump. The presupply pump can be driven until the presupply pump is switched off. Then, the fuel pressure in the fuel supply system can be reduced to the ambient pressure. The engine stalls as soon as a sufficient injection of fuel is no longer possible because of the low fuel pressure. The reduction of the fuel pressure in the fuel supply system to a low value of this kind serves to function, for example, in service centers to reduce the fuel pressure as far as possible in order to make possible an opening of the high-pressure loop of the fuel supply system for repair purposes without danger.

According to a further preferred embodiment of the present invention, it is suggested that a quantity control valve of the high-pressure supply pump be driven for driving the high-pressure supply pump. The pressure control controls the quantity control valve at the high-pressure supply pump in such a manner that the desired pressure is adjusted in the fuel supply system.

According to another advantageous embodiment of the present invention, it is suggested that the pressure reduction operation is controlled by a control of the internal combustion engine. The pressure-reduction operation is preferably initiated and/or ended by applying one or a sequence of pregiven control commands to the control of the internal combustion engine. The control commands define, for example, a request off a mechanic or another person to run through a selected maintenance or repair cycle with the engine and to transfer the fuel supply system into the pressure-reduction operation for this purpose.

As a further solution of the present invention, a control of the internal combustion engine of the type mentioned initially herein is suggested which has means for controlling the operation of the fuel supply system and of the engine in a pressure-reduction operation in accordance with the method of the invention.

In the control of the engine, an additional function, can, for example, be provided via which the fuel supply system and the engine can be operated in the pressure reduction operation. The additional functions can, for example, be integrated in the control apparatus software. The additional function of the control of the engine can be requested and called up by a mechanic or another person. With the call-up of the pressure-reduction operation, the engine is advised that no conventional operation is to take place but that a reduction of the fuel pressure in the fuel supply system should be carried out. The method of the invention can then run automatically controlled by the control of the engine. The fuel pump is correspondingly driven. The method is ended after the completion of the pressure release operation. The end of the pressure-reduction operation can be told to the control, in turn, by the mechanic or another person via one or a sequence of pregiven control commands.

BRIEF DESCRIPTION OF THE DRAWINGS

In the following, two preferred embodiments of the present invention are explained in detail with respect to the drawings, which include.

DESCRIPTION OF THE PREFERRED EMBODIMENTS OF THE INVENTION

The method of the invention serves the function to reduce the fuel pressure in a return-free supply system of an internal combustion engine to a desired pressure value. The method can be carried out during the operation of the engine in order to adapt the fuel pressure to the particular operating point of the engine. Usually, the method is, however, called up in a service station by a tester of the service station in order to make possible a repair of the fuel supply system without danger. Here, the fuel pressure can also drop below values, which are needed for the operation of the engine, to the ambient pressure.

The fuel supply system is preferably a common-rail storage injection system for a direct-injecting internal combustion engine, especially a gasoline engine. In the common-rail storage injection system, fuel is pumped from a fuel tank via a high-pressure line to a high-pressure store located on the engine. The fuel is pumped from the fuel tank by means of a presupply pump, which is preferably configured as an electric fuel pump, and a downstream requirement-controlled high-pressure supply pump into a high-pressure fuel store. Because this is a return-free fuel supply system, no return line from the high-pressure fuel store to the fuel tank is present in order to pump fuel back into the fuel tank which is not needed by the engine.

Figure 1:
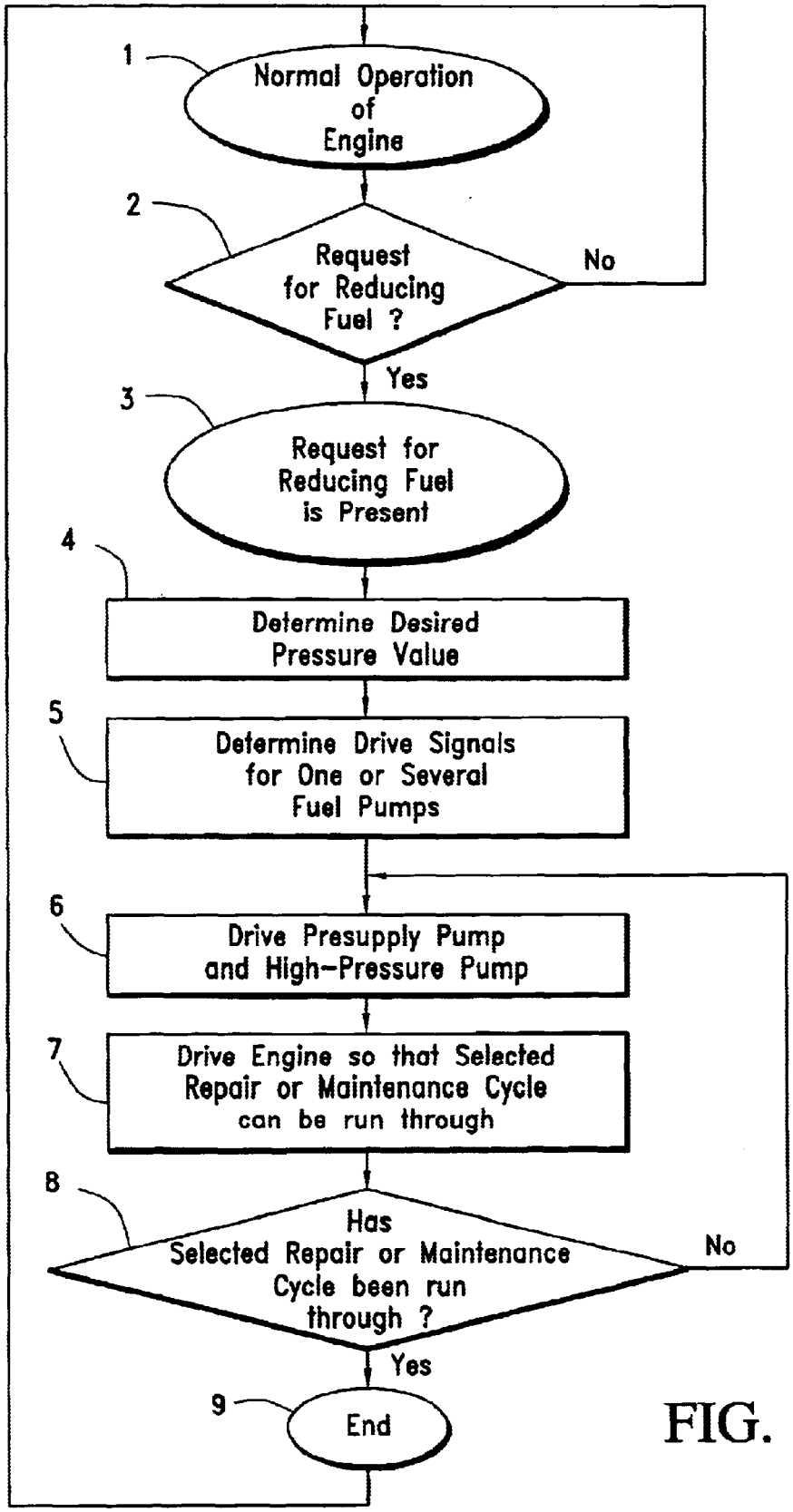
FIG. 1 is a flow diagram of a method of the invention for reducing the fuel pressure in a return-free fuel supply system in accordance with a first preferred embodiment; and, FIG. 2 is a flowchart of a method according to the invention pursuant to a second preferred embodiment.

A function block 1 of FIG. 1 represents the normal operation of the engine at operating pressure. In an inquiry block 2, a check is made as to whether a request for reducing the fuel pressure is present. This request can, for example, be triggered by a mechanic or another person for maintenance or repair purposes of the engine. The request can, for example, be carried out by applying one or a sequence of pregiven control commands to a control of the engine. In the event that no request for reducing the fuel is present, branching takes place to function block 1 and the normal operation of the engine is continued.

If, in contrast, a request to reduce the fuel pressure is present, the method of the invention is started in function block 3. In function block 4, the desired pressure value is determined to which the fuel pressure in the fuel supply system is to be reduced starting from the operating pressure. The desired pressure value can, for example, be pregiven by the control of the engine, it can be selected by the person who has requested the reduction of the fuel pressure or the pressure value is fixed by the selection of a specific maintenance or repair cycle when calling up the method of the invention. Drive signals for one or several fuel pumps of the fuel supply system are determined in a function block 5. The drive signals are dependent upon the desired pressure value determined in the function block 4. The drive signals are so determined that, during operation of the engine in a pressure-reducing operation (function block 7) the desired pressure value is adjusted in the fuel supply system after some time. In the present embodiment, drive signals for the high-pressure supply pump of the common-rail storage injection system are determined. Likewise, drive signals for the presupply pump can be determined. This is then necessary when the fuel pressure in the fuel supply system, especially in the high-pressure store, is to be reduced to a value which lies below the pressure value generated by the presupply pump, for example, for repair purposes.

In a function block 6, the presupply pump and the high-pressure pump of the common-rail storage injection system are driven by drive signals determined in function block 5 so that the desired pressure value, which is determined in function block 4, is adjusted in the common-rail storage injection system. Additionally, the internal combustion engine is driven in a function block 7 in such a manner that the selected repair or maintenance cycle can be run through. In the present embodiment, the engine is operated at idle. The fuel supply system and the engine are operated in the function blocks 6 and 7 in the pressure reduction mode.

In inquiry block 8, a check is made as to whether the selected repair or maintenance cycle has been completely run through and whether the reduction of the fuel pressure in the fuel supply system can be ended. In the event that the repair or maintenance cycle was not yet run through completely, branching to function blocks 6 and 7 takes place and the pressure reduction operation is continued. If the selected repair or maintenance cycle was run through completely, the method of the invention is ended in function block 9. Thereafter, there is a branching to function block 1 and the engine is again operated in the normal mode.

Figure 2:
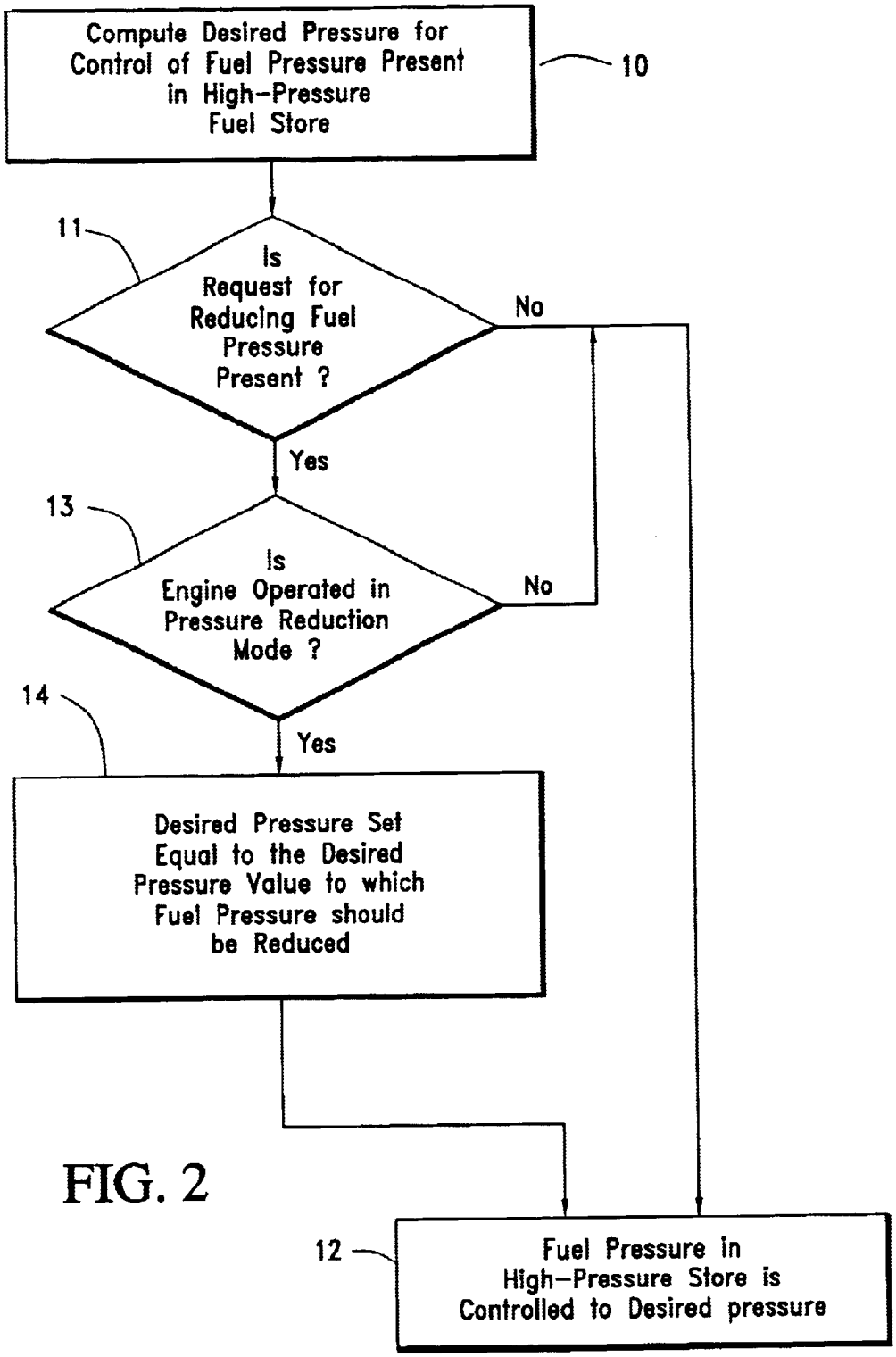

In FIG. 2, an alternate embodiment of the method of the invention is shown. First, a desired pressure for a control of the fuel pressure present in the high-pressure fuel store is computed in a function block 10. In a next inquiry block 11, a check is made as to whether a request for reducing the fuel pressure is present. In the event that no request for reducing the fuel pressure is present, the desired pressure, which was computed in function block 10, is transmitted in function block 12 to the control or the fuel pressure in the fuel high-pressure store.

However, in the event that a request is present for reducing the fuel pressure in the common-rail storage injection system, a check is made in a further inquiry block 13 as to whether the engine is operated in the pressure reduction mode, especially in idle. If the engine is not operated in idle, this means that a selected repair or maintenance cycle cannot be run through. In this case, the desired pressure, which is likewise computed in the function block 10, is transmitted in function block 12 to the control of the fuel pressure in the fuel high-pressure store.

In the event that the engine is, however, operating in idle, the requested repair or maintenance cycle can be run through. In a function block 14, the desired pressure is set equal to the desired pressure value to which the fuel pressure should be reduced in the context of the requested repair or maintenance cycle. In function block 12, the desired pressure value from function block 14 is supplied as desired pressure to the control of the fuel pressure in the fuel high-pressure store. The control then controls the presupply pump and the high-pressure supply pump of the fuel supply system correspondingly to achieve the desired pressure value in the fuel supply system.

The fuel pressure in the fuel high-pressure store is controlled in function block 12 to the desired pressure from function block 10 (normal operation of the engine) or from function block 14 (pressure-reduction mode).

What is claimed is:

1. A method for reducing the fuel pressure to a desired pressure value in a return-free fuel supply system of an internal combustion engine having a control for controlling said engine, the method comprising the steps of:

supplying said engine with fuel by at least one fuel pump of said fuel supply system during a normal mode;

applying to said control a control command or a sequence of pregiven control commands from outside and independently of said engine to initiate and/or end a pressure-reduction mode to reduce said fuel pressure; and, controlling said fuel pump during said pressure-reduction mode so that said fuel pressure in said fuel supply system goes to said desired pressure value.

2. The method of claim 1, wherein said control command or said sequence of pregiven control commands is applied by a person to carry out maintenance work or repairs.

3. The method of claim 2, wherein said engine is operated during said pressure-reduction mode in an operating state which is dependent upon a maintenance or repair cycle which is run through during said pressure-reduction mode.

4. The method of claim 1 wherein said fuel supply system is a high-pressure fuel supply system having a presupply pump and a high-pressure supply pump; and, wherein said high-pressure supply pump is driven in such a manner during said pressure-reduction mode that the fuel pressure in said fuel supply system adjusts to said desired pressure value.

5. The method of claim 4, wherein a quantity control valve of said high-pressure supply pump is driven in said pressure-reduction mode.

6. The method of claim 5, wherein said presupply pump is driven in said pressure-reduction mode.

7. The method of claim 1, wherein said pressure-reduction mode is controlled by said control of said engine.

8. A control arrangement of an internal combustion engine having a return-free fuel supply system wherein at least one fuel pump is arranged, the control arrangement comprising:

means for controlling the operation of said engine in a normal mode wherein said fuel pump is supplied with fuel;

means for receiving a control command or a sequence of pregiven control commands;

said receiving means being so configured that said receiving means receives said control command or said sequence of pregiven control commands which can be applied from outside to said control arrangement independently of said engine;

means for checking whether said control command or said sequence of pregiven control commands define a request of a pressure-reduction mode;

means for switching said engine over into said pressure-reduction mode wherein said control arrangement drives or controls said fuel pump in such a manner that a desired pressure value adjusts which is reduced relative to said normal mode.

9. The control arrangement of claim 8, wherein said control arrangement controls said pressure-reduction mode.

10. The control arrangement of claim 8, wherein said control arrangement operates said engine during said pressure-reduction mode in an operating state which is dependent upon a maintenance or repair cycle which said engine runs through during said pressure-reduction mode.

* * * * *